US006802962B1

(12) United States Patent
Browne, III et al.

(10) Patent No.: US 6,802,962 B1
(45) Date of Patent: Oct. 12, 2004

(54) DECK DRAIN COVER PLATE ASSEMBLY

(75) Inventors: Albert E. Browne, III, Martinsburg, WV (US); Jeffrey W. Gibbs, Stafford, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 63 days.

(21) Appl. No.: 10/153,208

(22) Filed: May 23, 2002

(51) Int. Cl.[7] ..... B01D 35/02

(52) U.S. Cl. ..... 210/164; 210/232; 210/474; 292/62; 292/129; 4/292

(58) Field of Search ..... 210/163, 164, 210/170, 232, 474, 499; 292/57, 62, 95, 129; 4/292

(56) References Cited

U.S. PATENT DOCUMENTS

| | | | | | |
|---|---|---|---|---|---|
| 386,768 | A | * | 7/1888 | Burrows | 210/164 |
| 921,123 | A | * | 5/1909 | Kurz | 210/163 |
| 1,195,827 | A | * | 8/1916 | Lucke | 210/163 |
| 1,541,436 | A | * | 6/1925 | Reshan | 210/163 |
| 2,003,770 | A | * | 6/1935 | Goodhart | 210/163 |
| 2,800,231 | A | * | 7/1957 | Hicks | 4/292 |
| 4,871,451 | A | | 10/1989 | Piskula | |
| 4,943,100 | A | | 7/1990 | Emberson | |
| 5,324,135 | A | * | 6/1994 | Smith | 210/164 |
| 5,345,741 | A | * | 9/1994 | Slater et al. | 210/164 |
| 5,575,903 | A | | 11/1996 | Kato | |
| 5,864,990 | A | * | 2/1999 | Tu | 210/163 |
| 5,934,331 | A | | 8/1999 | Earl | |
| 6,014,780 | A | | 1/2000 | Jurek et al. | |
| 6,076,559 | A | | 6/2000 | Castillo et al. | |
| 6,108,828 | A | | 8/2000 | Cheng | |
| 6,165,357 | A | | 12/2000 | Cormier | |
| 6,209,586 | B1 | | 4/2001 | Wright | |
| 6,214,216 | B1 | | 4/2001 | Isaacson | |
| 6,450,125 | B2 | * | 9/2002 | McElroy | 119/529 |

* cited by examiner

*Primary Examiner*—Christopher Upton
(74) *Attorney, Agent, or Firm*—Jacob Shuster

(57) ABSTRACT

An easy access deck drain cover assembly with a strainer plate having a removable hinge at one end and a removable locking mechanism opposite the hinge where the locking mechanism includes a J-bolt coupled to the strainer plate and means for engaging the bottom of the J-bolt to secure the strainer plate in a closed position. The strainer plate cover remains connected to the deck drain even when opened so that the deck drain may be serviced.

4 Claims, 2 Drawing Sheets

DECK DRAIN COVER PLATE ASSEMBLY

STATEMENT OF GOVERNMENT INTEREST

The invention described herein may be manufactured and used by or for the Government of the United States of America for governmental purposes without payment of any royalties thereon or therefore.

BACKGROUND OF THE INVENTION

This invention relates to deck drains and more particularly to deck drains specifically suited for ships, though not intended exclusively for ship use.

Drain covers on ship decks are used to prevent debris from clogging deck drains and drainpipes. Deck drains and adjoining drainpipes direct water either overboard or to a retention area. However, even with drain covers most deck drains will become clogged periodically. Most of the covers currently used have a series of screws that must be removed in order to remove the cover strainer plate to gain access to the deck drain and drainpipe for cleaning or snaking in order to remove an obstruction. Because of the harsh environment that the deck drain is in the screws often become corroded and difficult or impossible to remove in the standard fashion. Over time the threads of the screws become stripped or damaged and in turn damage the female threads of the deck drain. This can result in extensive repairs or replacement being required in order to bring the deck drain back into operation. Additionally, screws are often lost or misplaced on rolling decks of ships. Harsh environments with some of the same problems are found in industrial areas that have floor drains.

Accordingly, there is a need for a securable drain cover that is easy to lift for access to the drainpipe and has no removable parts that may be lost or damaged during routine maintenance. Further, there is need for a drain cover that even if damaged or corroded may be replaced or repaired if necessary without having to replace the entire deck drain.

SUMMARY OF THE INVENTION

A deck drain cover assembly with a strainer plate having a hinge at one end and a locking mechanism opposite the hinge where the locking mechanism includes a J-bolt coupled to the strainer plate and means for engaging the bottom of the J-bolt to secure the strainer plate closed.

The drain cover assembly preferably has a pair of retainers each having a hinge pin at one end secured to a deck drain. The retainers engage a hole in a finger of a strainer plate and serve as the pivot point for lifting the strainer plate. The strainer plate has an aperture on the other side of the strainer plate with a nut attached to the bottom of the strainer plate axial with the aperture. A spring is disposed inside and axial with the aperture and abuts the nut attached to the bottom of the strainer plate. A J-bolt passes through the aperture, the center of the spring, and the nut so as to have the bolt head accessible from the top of the strainer plate. A catch is secured to the side of the deck drain below the aperture so that the bottom of the J-bolt can be rotated to engage the catch and hold the strainer plate closed under the bias of the spring. In one embodiment of the invention there is a groove on the top of the strainer plate around the aperture so that a sliding cover may be inserted and moved to either cover the head of the J-bolt for protection or to expose the head of the J-bolt so that it may be rotated. In another aspect of the present invention the cover is a snap on cover, preferably made of plastic, that fits snugly in the aperture to cover the J-bolt head when the strainer plate is in the locked down position.

Still other aspects of the present invention will become apparent to those skilled in the art from the following detailed description of the preferred embodiment. It is possible to modify the invention in obvious respects without departing from the invention. Accordingly, the drawings and description are to be regarded as illustrative in nature, and not as restrictive.

DESCRIPTION OF THE PREFERRED EMBODIMENTS

Figure 1:
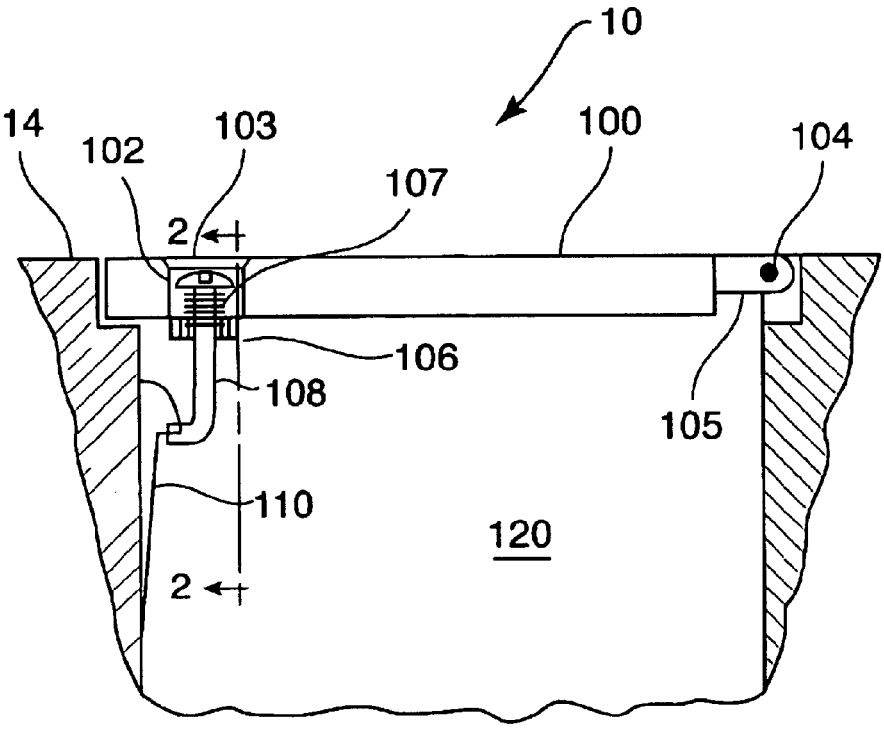
FIG. 1 is a cross sectional view of a drain cover according to this invention.
Figure 3:
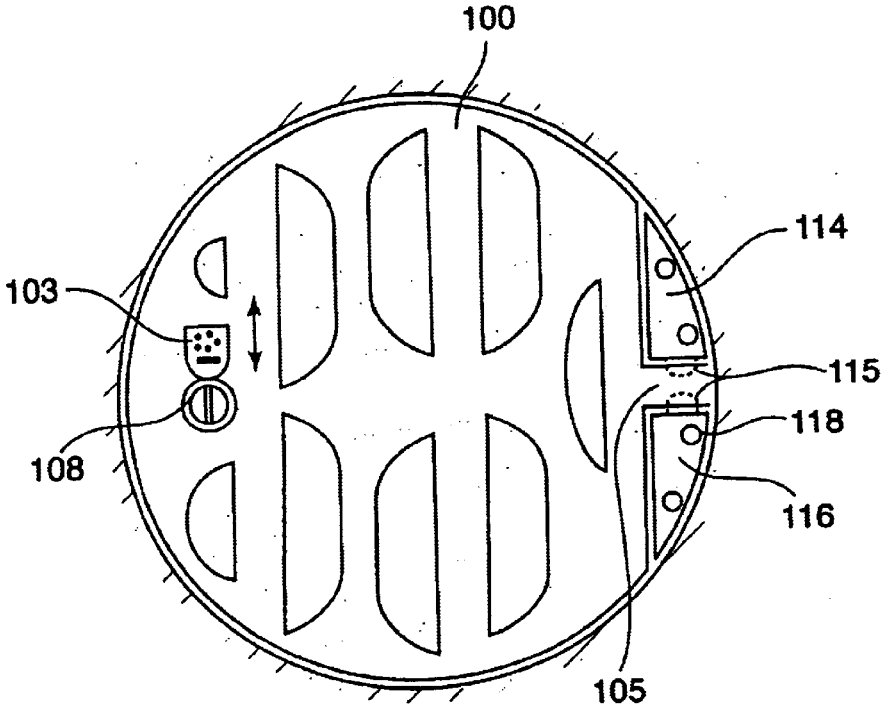
FIG. 3 is a plan view of a drain cover according to this invention.

Referring more particularly to the drawings, FIG. 1 shows a deck drain cover assembly 10 adapted to fit inside the rim 12 of a deck drain 120. The deck drain cover assembly 10 is adapted so that a top surface of a strainer plate 100 is flush with a deck surface 14 to be drained of fluid. The strainer plate 100 has a finger 105 at one end and an aperture 102 adjacent an opposite end, with the finger 105 going through the strainer plate surface. The finger 105 has a hole 104 through it so that it may receive hinge pins 115 as shown in FIG. 3. Attached to the bottom of the strainer plate 100 is a nut 106 or other retention device that serves to retain a J-bolt 108 fastener and support a spring 107 within the aperture 102. The nut 106 preferably has male threads and is secured in the aperture 102. A spring 107 is disposed inside and axial with the strainer plate aperture 102 and abuts the nut 106 and a head 109 of the J-bolt 108. The J-bolt 108 passes through the strainer plate aperture 102, the spring 107, and the nut 106. The head 109 of the J-bolt 108 is accessible from the top of the strainer plate 100 and is slotted so that the J-bolt 108 may be rotated. In the preferred embodiment, the strainer plate aperture 102 is grooved so that a sliding plastic cover 103 may be slidably inserted to allow access to the J-bolt head 109 as needed and to offer protection to the head 109 of the J-bolt 108 and the spring 107. Another embodiment would use a flip top cover that could be popped open or closed over the head 109 of the J-bolt 108.

The edge rim 12 at the top of the deck drain 120 is used as a mounting surface for a first retaining piece 114 and a second retaining piece 116 that provide hinge joints for the strainer plate 100. The first retaining piece 114 and the second retaining piece 116 are preferably made of a suitable metal such as bronze or aluminum chosen to be compatible with the deck drain material. These retaining pieces 114 and 116 may be secured in place by using heavy duty alien head screws 118 or other suitable attachment means. Each of the retaining pieces 114 and 116 has one of the a hinge pins 115 attached thereto as shown in FIG. 3. The hinge pin 115 of the first retaining piece 114 engages one side of the aperture 104 of the finger 105 of the strainer plate 100, and the hinge pin 115 of the second retaining piece 116 engages the opposite side of the aperture 104 of the finger 105 to allow the strainer plate 100 to pivot between open and closed Positions while still being mechanically connected to the deck drain.

Figure 2:
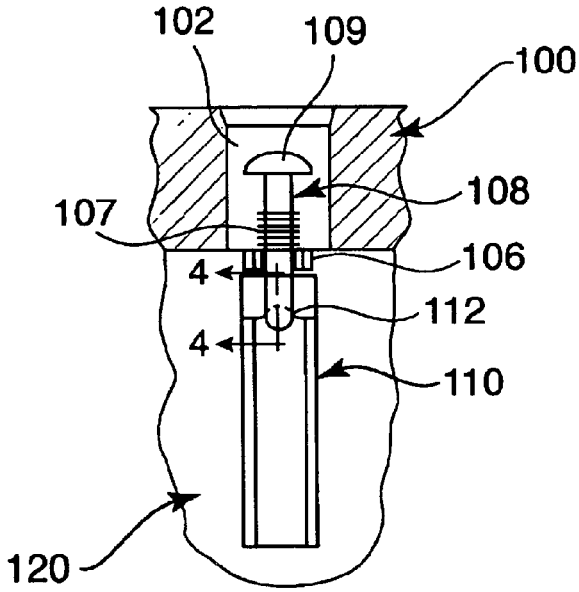
FIG. 2 is a partial sectional view taken along section line 2—2 in FIG. 1.
Figure 4A:
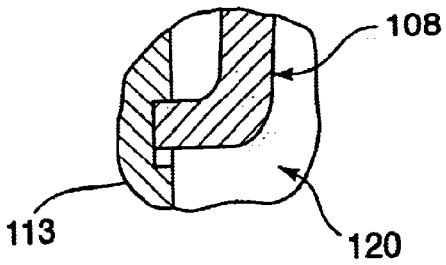
FIG. 4A is a partial section view corresponding to that of FIG. 4, showing an alternative embodiment.
Figure 4:
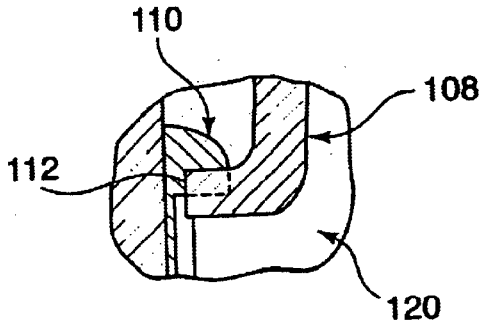
FIG. 4 is a partial section view taken substantially through a plane indicated by section line 4—4.

Also secured to the side of the deck drain 120 is a catch 110, as shown in FIGS. 2 and 4, below the strainer plate aperture 102. When the J-bolt 108 is pressed down against the bias of the spring 107 and rotated it engages a groove 112 in the catch 110 and holds the strainer plate 100 closed under the bias of the spring 107 as illustrated in FIG. 1. The catch 110 is preferably made of a suitable metal that is compatible with the deck drain material. The catch 110 is secured to the deck drain 120 by either tack welding or fastening means such as screws sized so that the wall of the deck drain 120 is not penetrated completely through. In an alternative embodiment as shown in FIG. 4A a groove 113 is cut into or premanufactured in the side of the deck drain opposite the hinge retaining pieces. This embodiment requires that the aperture 102 in the strainer plate 100 be located so that the J-bolt 108 may rotatably engage the groove in the side of the deck drain 120.

What has been described is only a few of many possible variations on the same invention and is not intended in a limiting sense. The claimed invention can be practiced using other variations not specifically described above.

What is claimed is:

1. A deck drain cover assembly comprising:

a pair of retainers each having a hinge pin at one end secured to a deck drain;

a strainer plate having a finger at one end and an aperture opposite said finger, said finger including an opening sized to hold said hinge pin;

a nut attached to the bottom of said strainer plate axial with said strainer plate aperture;

a spring disposed inside and axial with said strainer plate aperture and abutting said nut;

a J-bolt passing through said strainer plate aperture, said spring and said nut, said J-bolt having a head accessible from a top of said strainer plate and abutting said spring; and lock means located below said strainer plate aperture, so as to engage a bottom of said J-bolt and hold said strainer plate closed under the bias of said spring.

2. A deck drain cover assembly as in claim 1, further comprising means for covering said strainer plate aperture when said J-bolt is hooked on said lock means.

3. A deck drain cover assembly as in claim 2, wherein said lock means includes a catch secured to the inside wall of said deck drain below said so plate aperture so as to engage the bottom of said J-bolt and holding said strainer plate closed under the bias of said spring.

4. A deck drain cover assembly as in claim 2, wherein said lock means includes a groove on the inside wall of said deck drain below said strainer plate aperture so the bottom of said J-bolt may rotatably engage said groove and thereby hold said strainer plate closed under the bias of said spring.

* * * * *